US011741792B2

(12) United States Patent
Hudson

(10) Patent No.: US 11,741,792 B2
(45) Date of Patent: Aug. 29, 2023

(54) LOTTERY SYSTEM AND METHOD

(71) Applicant: Brian J. Hudson, Oroville, CA (US)

(72) Inventor: Brian J. Hudson, Oroville, CA (US)

( * ) Notice: Subject to any disclaimer, the term of this patent is extended or adjusted under 35 U.S.C. 154(b) by 0 days.

(21) Appl. No.: 17/879,886

(22) Filed: Aug. 3, 2022

(65) Prior Publication Data

US 2023/0048059 A1 Feb. 16, 2023

Related U.S. Application Data

(60) Provisional application No. 63/233,534, filed on Aug. 16, 2021.

(51) Int. Cl.
*G07F 17/32* (2006.01)

(52) U.S. Cl.
CPC ..... *G07F 17/329* (2013.01); *G07F 17/3258* (2013.01)

(58) Field of Classification Search
CPC ..... G07F 17/329; G07F 17/3258; A63F 3/06
See application file for complete search history.

(56) References Cited

U.S. PATENT DOCUMENTS

| | | | | |
|---|---|---|---|---|
| 6,874,783 | B2 | 4/2005 | Higginson | |
| 7,909,691 | B1 | 3/2011 | Skatter | |
| 8,070,590 | B2 | 12/2011 | Cannon et al. | |
| 8,157,635 | B2 | 4/2012 | Hardy et al. | |
| 8,715,071 | B2 | 5/2014 | Keenan et al. | |
| 10,176,674 | B2 | 1/2019 | Katz et al. | |
| 2003/0122303 | A1* | 7/2003 | Moore | A63F 3/06 273/269 |
| 2005/0192078 | A1 | 9/2005 | Jawaharlal | |
| 2006/0178194 | A1* | 8/2006 | Jubinville | G07F 17/329 463/17 |
| 2007/0287520 | A1* | 12/2007 | Nalker | G07C 15/005 463/17 |
| 2009/0156285 | A1* | 6/2009 | Amada | G07F 17/32 463/17 |
| 2009/0176549 | A1 | 7/2009 | Saig et al. | |
| 2010/0019453 | A1 | 1/2010 | Oakes et al. | |
| 2010/0029376 | A1 | 2/2010 | Hardy et al. | |
| 2011/0009176 | A1* | 1/2011 | Knebli | G07F 17/329 463/17 |
| 2011/0117985 | A1* | 5/2011 | Badrieh | A63F 13/80 463/17 |
| 2012/0071222 | A1 | 3/2012 | Burks et al. | |
| 2013/0310133 | A1 | 11/2013 | Walker et al. | |
| 2015/0221161 | A1 | 8/2015 | Reid et al. | |
| 2016/0101348 | A1* | 4/2016 | Rogers | G07F 17/3267 463/40 |
| 2016/0275754 | A1* | 9/2016 | Hanus | G07F 17/329 |

FOREIGN PATENT DOCUMENTS

WO 0247010 A1 6/2002

* cited by examiner

*Primary Examiner* — Milap Shah

(57) ABSTRACT

A system and method for an improved lotto game where the number of winning matching numbers depends on the size of the pot generated through the month and will be displayed at every lottery retailer and kiosk whereby an amount will be distributed to the winners. The system sells lottery tickets that each have a set cost and a unique identifying number to one or more players that may be selected by the players or automatically chosen by the system. The system then conducts multiple drawings such that multiple lottery tickets sold are winning tickets, and the remainder of lottery tickets sold are losing tickets.

15 Claims, 2 Drawing Sheets

LOTTERY SYSTEM AND METHOD

CROSS REFERENCE TO RELATED APPLICATIONS

This application claims priority to 63/233,534 filed on Aug. 16, 2021, which is incorporated in its entirety.

FIELD OF DISCLOSURE

The overall field of this invention is a system and method for a lottery game and more particularly, a system and method for placing, processing, and transmitting requests for a lotto game with multiple winners dependent on the size of the funds collected.

BACKGROUND

Lotteries have existed throughout the world for hundreds of years. Typical modern lottery formats often involve the selection by a customer or entrant of a predetermined quantity of lottery numbers (e.g., from a range of numbers) such as by writing such numbers down on a paper form which is submitted to a store clerk. Once the lottery ticket is paid for, such numbers are then entered into a machine which prints, on a second piece of paper, a lottery ticket which is issued to the lottery customer. Lottery winners in such conventional lotteries are eventually chosen by a lottery administrator which—via one or more conventional methods—draws or randomly selects winning numbers which an entrant must have selected, and thereby have a paper ticket with numbers matching the winning numbers, to win the lottery prize. Typically, multiple winners are chosen by how many of the numbers they have chosen but this leads to a few number of winners and even less winners who win a grand prize which can lead to people being less enthused about the prospect of winning unless the pool is of a significant sum. Thus, there exists the need for an improved lottery game system with multiple winners of a predetermined amount dependent on the size of the funds collected.

SUMMARY

The present disclosure recognizes the unsolved need for an improved system and method for an improved lotto game where the number of winning matching numbers depends on the size of the pot generated through the month and will be displayed at every lottery retailer and kiosk whereby an amount will be distributed to the winners. The system sells lottery tickets that each have a set cost and a unique identifying number to one or more players that may be selected by the players or automatically chosen by the system. The system then conducts multiple drawings such that multiple lottery tickets sold are winning tickets, and the remainder of lottery tickets sold are losing tickets.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
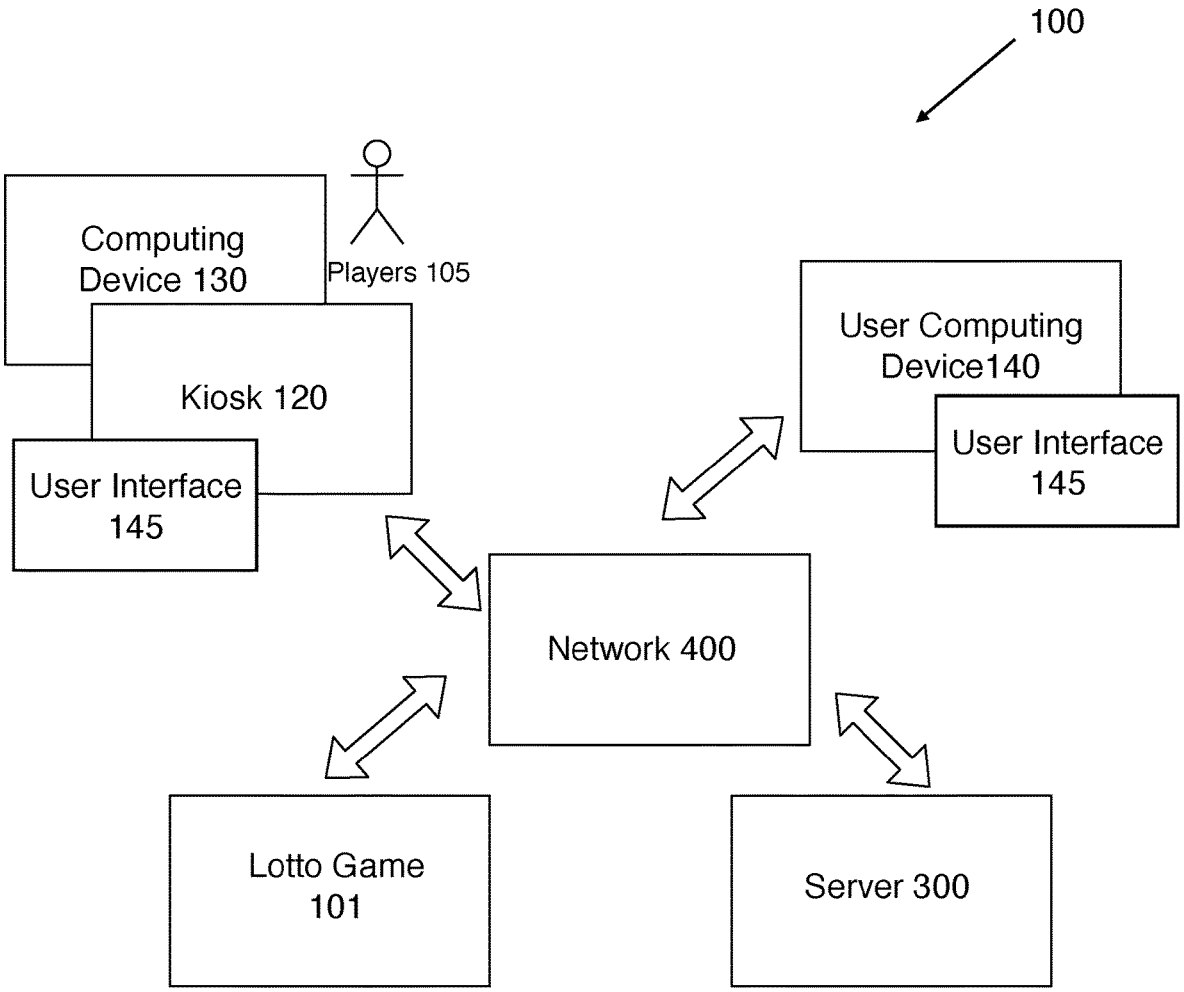
FIG. 1 depicts a block diagram of the lottery system.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skills in the art that the invention may be practiced without these specific details. In other instances, well-known features have not been described in detail to avoid unnecessarily complicating the description.

Turning to FIG. 1, FIG. 1 depicts a block diagram of an embodiment of the present invention for lotto system 100. Lotto system 100 may include a plurality of kiosks such as kiosks 120. Kiosks 120 may be located remotely from one another at different establishments whereby establishments are locations that a user may typically interact with, such as a gas station or grocery store. The establishments may also comprise dedicated gaming facilities (casinos) or other retail establishments. Establishments may be located in various geographical locations that are either located apart or are located in proximity to each other. Kiosks 120 may provide for an assortment of playing games that have unique and diverse selections for players 105 to select from, including lotto game 101 of lotto system 100. An order placed by players 105 may be processed by one or more computing devices 130 of kiosk 120, which are discussed in detail later in the description.

Additionally, players 105 may access and participate in lotto game 101 through one or more user computing devices 140. Lotto system 100 may be downloadable and installable on user computing devices 140 through an API 286. In one or more non-limiting embodiments, lotto system 100 may be preinstalled on user computing devices 140 by the manufacturer or designer. Further, lotto system 100 may be implemented using a web browser via a browser extension or plugin. A user interface 145, may be displayed on user computing device 140 as well as kiosk 120. User interface 145 may also be included with API 286.

Upon initially signing up with lotto system 100 through API 286, players 105 may be prompted to provide an email address or other identifying sources such as a telephone number. After entering an email address or other identifying source, players 105 may be presented with a text window interface whereby players 105 may enter their name, username, password, phone number, and address.

A server 300 may cooperate with computing devices 130 and user computing devices 140 to enable players, preferably at many different remote locations including from kiosks 120 and user computing devices 140, to participate in lottery games. Server 300 may comprise a database server such as MySQL® or Maria DB® server. Lotto system 100 may be distributed across multiple servers that may be in the same location or different locations in any arrangement. Server 300 may have several databases, including a database for storing data for users' profiles and kiosks profiles.

Server 300 may comprise a number of modules that provide various functions related to lotto system 100 using one or more computing devices similar to computing devices 130. Modules may be in the form of software or computer programs that interact with the operating system of server 300 whereby data collected in databases may be processed by one or more processors within server 300 or another component of lotto system 100 as well as in conjunction with execution of one or more other computer programs. Modules may be configured to receive commands or requests from computing devices 130 of kiosks 120 and user computing devices 140.

Server 300 may include a module for creating lottery games and dividing the lottery games into distribution groups. Server 300 also includes a component for creating promotion records for use in distributing promotion prizes according to the invention. A game play record distribution component may also be implemented at server 300 for distributing the distribution groups and promotion records to a game play record assignment component responsible for assigning game play records and promotion records to players participating in the lottery games.

Server 300 may run any number of algorithms to proactively respond to the conditions based on kiosk 120 settings or system assumptions, such as if kiosk 120 is broken or if the authentication continuously fails more than twice within a set timeframe, server 300 may automatically report player 105 to a system administrator.

Continuing with lotto system 100, computing devices 130 of kiosk 120 and user computing devices 140, and server(s) 300 may all be communicatively connected to network 400. In one or more embodiments, network 400 may include a local area network (LAN), such as a company Intranet, a metropolitan area network (MAN), or a wide area network (WAN), such as the Internet or World Wide Web. Network 400 may be a private network or a public network, or a combination thereof. Network 400 may be any type of network known in the art, including telecommunications networks, a wireless network (including Wi-Fi), and a wireline network. Network 400 may include mobile telephone networks utilizing any protocol or protocols used to communicate among computing devices 130 and user computing devices 140, such as GSM, GPRS, UMTS, AMPS, TDMA, or CDMA. In some embodiments, different types of data may be transmitted via network 400 via different protocols.

Network 400 may further include a system of terminals, gateways, and routers. Network 400 may employ one or more cellular access technologies including 2nd (2G), 3rd (3G), 4th (4G), 5th (5G), LTE, Global System for Mobile communication (GSM), General Packet Radio Services (GPRS), Enhanced Data GSM Environment (EDGE), and other access technologies that may provide for broader coverage between computing devices and establishment computing devices if, for instance, they are in a remote location not accessible by other networks.

Figure 2:
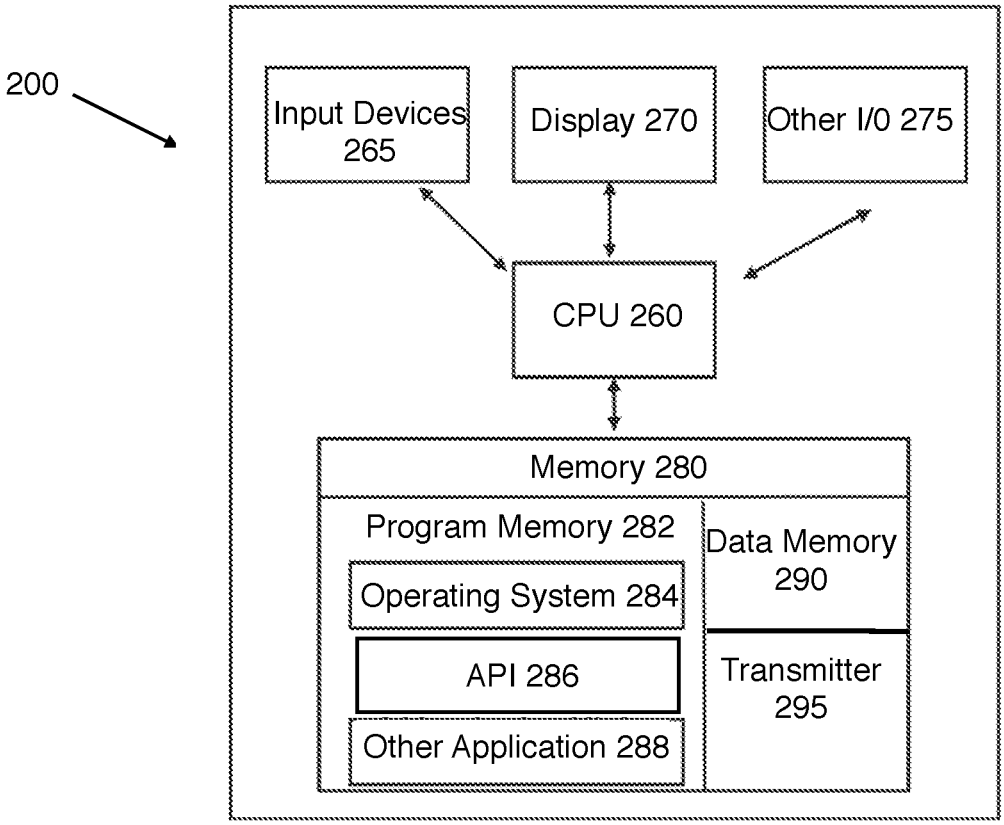
FIG. 2 depicts a block diagram of the computing devices of the lottery system.

Turning to FIG. 2, FIG. 2 is a block diagram showing various components of user computing device 140 and computing device 130 of kiosk 120. User computing device 140 and computing device 130 may comprise a housing for containing one or more hardware components that allow access to edit and query lotto system 100. User computing device 140 and computing device 130 may include one or more input devices such as input devices 265 that provide input to a CPU (processor) such as CPU 260 of actions related to player 105. Input devices 265 may be implemented as a keyboard, a touchscreen, a mouse, via voice activation, wearable input device, a camera, a trackball, a microphone, a fingerprint reader, an infrared port, a controller, a remote control, a fax machine, and combinations thereof.

The actions may be initiated by a hardware controller that interprets the signals received from input device 265 and communicates the information to CPU 260 using a communication protocol. CPU 260 may be a single processing unit or multiple processing units in a device or distributed across multiple devices. CPU 260 may be coupled to other hardware devices, such as one or more memory devices with the use of a bus, such as a PCI bus or SCSI bus. CPU 260 may communicate with a hardware controller for devices, such as for a display 270. Display 270 may be used to display text and graphics. In some examples, display 270 provides graphical and textual visual feedback to a user.

In one or more embodiments, display 270 may include an input device 265 as part of display 270, such as when input device 265 is a touchscreen or is equipped with an eye direction monitoring system. In some implementations, display 270 is separate from input device 265. Examples of display 270 include but are not limited to: an LCD display screen, an LED display screen, a projected, holographic, virtual reality display, or augmented reality display (such as a heads-up display device or a head-mounted device), wearable device electronic glasses, contact lenses capable of computer-generated sensory input and displaying data, and so on. Display 270 may also comprise a touch screen interface operable to detect and receive touch input such as a tap or a swiping gesture. Other I/O devices such as I/O devices 275 may also be coupled to the processor, such as a network card, video card, audio card, USB, FireWire or other external device, camera, printer, speakers, CD-ROM drive, DVD drive, disk drive, or Blu-Ray device. In further non-limiting embodiments, a display may be used as an output device, such as, but not limited to, a computer monitor, a speaker, a television, a smart phone, a fax machine, a printer, or combinations thereof.

CPU 260 may have access to a memory such as memory 280. Memory 280 may include one or more of various hardware devices for volatile and non-volatile storage and may include both read-only and writable memory. For example, memory 280 may comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. Memory 280 may be a non-transitory memory.

Memory 280 may include program memory such as program memory 282 capable of storing programs and software, including an operating system, such as operating system 284. Memory 280 may further include an application programing interface (API), such as API 286, and other computerized programs or application programs such as other application programs 288. Memory 280 may also include data memory such as data memory 290 that may include database query results, configuration data, settings, user options, user preferences, or other types of data, which may be provided to program memory 282 or any element of user computing device 140.

User computing device 140 and computing device 130 may, in some embodiments, be a computing device such as a merchant terminal device, dedicated register device, iPhone™ Android-based phone, or Windows-based phone, a tablet, television, desktop computer, laptop computer, gaming system, wearable device electronic glasses, networked router, networked switch, networked, bridge, or any computing device capable of executing instructions with sufficient processor power and memory capacity to perform operations of lotto system 100 while in communication with network 400. Computing device 130 may have location tracking capabilities such as Mobile Location Determination System (MLDS) or Global Positioning System (GPS) whereby they may include one or more satellite radios capable of determining the geographical location of a computing device.

User computing device 140 and computing device 130 may have a transmitter 295, such as transmitter 295, to transmit data. Transmitter 295 may have a wired or wireless connection and may comprise a multi-band cellular transmitter to connect to the server 300 over 2G/3G/4G cellular networks. Other embodiments may also utilize Near Field Communication (NFC), Bluetooth, or another method to communicate information.

Players 105 may participate in lotto game 101 offered through lotto system 100 by entering game play requests at any one of a number of kiosks 120 included in the system 100 or through user computing devices 140.

Players 105 may initiate a session over network 400 with user computing device 140 or computing device 130. The session may be initially started by player 105 launching and running API 286 on user computing device 140 installed by player 105 through a manufacturer prescribed process such as downloading API 286 from an application store or API 286 may be preinstalled by the manufacturer or designer. In some embodiments, players 105 may travel to a kiosk 120.

Players 105 may then search for lotto game 101 on kiosk 120 by clicking a "millionaire" button. A search request having a character string may also be used. For example, if players 105 want to locate lotto game 101, players may type "millionaire" with a search request through user interface 145. Server 300 may access the server database and return lotto game 101.

Players 105 may then begin to browse through options presented through user interface 145. These selections may be displayed through a list or a drop-down menu on user interface 145 of kiosk 120 or user computing device 140.

To place an order for a lotto ticket, lotto system 100 may use one or more algorithms to create a random number combination for players 105 where a set of numbers may be randomized and selected for players 105. After using the numbers once, players 105 may set lotto system 100 so new random numbers are picked or may save the random numbers. Additionally, lotto system 100 may display numbers previously picked and how many times whereby players 105 may be presented options where one or more algorithms can present players with multiple options such as similar numbers to the ones already chosen or numbers that are completely different depending on the user selection or stored data. The one or more algorithms may also determine numbers that are working well for players 105 in previous games and insert those automatically. The number of numbers may be six, however this is non-limiting and may range from one to hundred. In some non-limiting embodiments, no same number combinations may exist. The price of a lotto ticket may be 2 dollars; however, this is non-limiting and may be any amount. Players 105 may add additional lotto tickets to their order or return to a previous menu. Once one or more selections of lotto tickets have been chosen, the selections are placed in a shopping cart and the selections appear in the order list. As selections are added to the order list, a sub-total is calculated.

If satisfied with the order of the shopping cart, players 105 may proceed to checkout using an appropriate button. If players 105 are not satisfied, they may cancel one or more specific selections or lotto tickets in the order list or modify a selection, returning players 105 to a previously engaged menu session to alter the selection.

User interface 145 may display to players 105 the final order summary, the price information including subtotal, discounts and taxes, promotional coupon and gift card entry fields, mode of payment, and calculated total including subtotal combined with taxes, discounts, and gratuity added. Players 105 may input their credit card information for a credit card using any credit card known in the art, including, without limitation an ATM card, a VISA®, MasterCard®, Discover®, or American Express® card in a credit card input field, or can alternatively use PayPal® or the like. Players 105 may submit the payment information via an appropriate button through user interface 145 or return to an earlier step in the session.

Server 300 may then receive an order over network 400 initiated by players 105. The order may indicate a specific player 105 sending the order for lotto tickets, the number of lotto tickets, the numbers selected, and one or more selections chosen by players 105, and payment information. The payment information is then submitted and confirmed (e.g., by server 300 in one exemplary embodiment) for processing of the payment. While server 300 is processing the payment, the appropriate systems or providers are contacted in order to complete the transaction and payment is transferred from players 105 to lotto system 100.

If the payment successfully transfers from players 105, a confirmation message may be displayed to confirm the time of purchase and the total price charged. If payment is declined, a failure message may be displayed to players 105 notifying players 105 the reason for the failed transaction. After the transaction is completed, a digital receipt of payment may be stored in databases of server 300 A confirmation for a game play request is presented to players 105 at kiosks 120 or user computing devices 140. Each lottery result correlates to a result defined by a respective game play record that is assigned for the lottery game play request. One or more physical or digital lotto tickets may then be printed or presented for display to players.

Winning numbers of lotto game 101 are selected by one or more software algorithms, based on a set number of prizes available and the number of entries received over a predetermined time period or upon completion of a set amount of player entries such that a set number of players win a million dollars each after taxes. The number of winning matching numbers depends on the size of the pot generated through a set time period such as a month and will be displayed at every kiosk 120 or user computing device 140. For example, if an amount in the sum of 56 million is received during a month, then there will be 56 drawings such that 56 players will have won a million dollars. If the amount received over a designated time period does not reach 1 million or another set number or is an uneven number, then this amount may be rolled over. In some non-limiting embodiments, if one million is not reached an advertising system may be initiated automatically with one or more stored advertisers who have a set amount they wish to provide to have an advertisement entered into the system. The more money that is needed to make the million or round up may automatically determine how long or how well pronounced the advertisement will be. This may be done nationwide or set up at a state or local scale with multiple games running simultaneously.

Players 105 may then check online, through user computing device 140, or at the various kiosks 120 to check for the winning numbers. If players 105 have matching winning numbers, players 105 have two options to claim prize money. A first option may be for a player 105 to visit a lottery district and fill out a claim form. If players 105 have a winning ticket, players 105 will receive a check for one million dollars minus all taxes. In a second option, players 105 may mail in their winning ticket whereby players 105 may fill out a claim form. Players 105 may mail the claim form along with the winning ticket. If the player's 105 numbers match, the player will receive a check in the mail for one million dollars minus all taxes.

In some non-limiting embodiments, players 105 may be enrolled by lotto system 100 to participate in one or more additional lotteries or supplemental lotteries. Winners of an instant additional lottery are selected by a software algorithm, based on the number of prizes available and the number of entries anticipated, upon completion of the players' entries. A winner may accept the designated prize or trade it for a specified number of points. Some non-limiting examples may include entering winners into a grand prize every year. Supplementary prizes or additional lotto tickets may also be given to losing players 105 if they return with a ticket and purchase or receipt of previous visit as well as in store discounts for store items or additional tickets. Supplementary prizes may also be given to losing players 105 if there are any unclaimed tickets after a predesignated time. This may be allotted to all the losing players 105 or a subset of players who have lost a predetermined number of times or by a regional rotation, or other factoring criteria. This may be done with the same numbers or varying numbers with the same amount or smaller amounts.

In some non-limiting embodiments, a trained machine learning algorithm may be used for estimating and establishing predicted dates of which a predetermined amount of prize money may be reached based on previous data to prepare the users as well as collect data for peak marketing and other patterns. The trained machine learning algorithm include a regression-based model that accepts the prior data including, prize data, user data, economic data of current inflation and landscape, or location of the individual previously playing. The trained machine learning algorithm may be part of an algorithm model. The trained machine learning algorithm may be of any suitable form, and may include, for example, a neural network. A neural network may be software representing human neural system (e.g., cognitive system). A neural network may include a series of layers termed "neurons or nodes." A neural network may comprise an input layer, to which data is presented; one or more internal layers; and an output layer. The number of neurons in each layer may be related to the complexity of a problem to be solved. Input neurons may receive data being presented and then transmit the data to the first internal layer through the connections' weight. A neural network may include, for example, a convolutional neural network, a deep neural network, or a recurrent neural network.

The trained machine learning algorithm may compute the future predicted amount of prizes data of the user as a function of the prior data and other data discussed, as well prior predicted data and any other information, as input data, or one or more variables indicated in the input data. The one or more variables may be derived from the prior data. This function may be learned by training the machine learning algorithm with training sets.

The machine learning algorithm may be trained by supervised, unsupervised, or semi-supervised learning using training sets comprising data of types similar to the type of data used as the model input. For example, the training set used to train the model may include any combination of the prior data. Additionally, the training set used to train the model may further include prize data, including, but not limited to, an actual name, contact information, taxes, proof of income documents, identity verification documents, or other documents with entity specific information and other data related to the user. Accordingly, the machine learning model may be trained to map input variables to a quantity or value of the amount of prize prediction overall or for a specific location. That is, the machine learning model may be trained to determine a quantity or value of the amount of prize prediction as a function of various input variables.

The trained machine learning model may utilize principal component analysis (PCA). The PCA may convert a set of variables or input data into a set of values of linearly uncorrelated variables, which include a first principal component that has the largest possible variance. For example, the prior data may be converted to a set of variables representing other characteristics. The PCA may be used to define one or more variables that are more important than other variables or reduce the number of variables needed to be trained and computed by a machine learning model. Overlapping qualities after a predetermined number of occurrences in past prizes over a certain range may create a cluster which then may be stored as one or more variables to speed up the process and calculate the income at a more accurate manner whereby the cluster provides a higher weighted average in the determination of the predicted number of prizes. In some alternative non-limiting embodiments user may scan their receipt having one or more inventory items at the establishment of which the kiosk is located at (or fill out a survey with similar information) whereby this may be considered a payment such that the receipt information may be combined with the user profile data and stored in the one or more databases for data analysis for overall consumer trends.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A lotto game system comprising:

one or more databases coupled via a network; and a computing system having one or more processors coupled to the one or more databases over the network, wherein instructions are executed by the computing system to perform:

generating multiple series of first numbers for a lotto game from one or more computing devices;

receiving one or more payments for the lotto game from the one or more computing devices;

creating a lotto ticket for the lotto game with a series of first numbers of the multiple series of first numbers;

storing the series of first numbers in the one or more databases and associating the series of first numbers with a first player of players;

determining an amount collected from the one or more payments over a predetermined amount of time;

determining that the amount collected has reached a predetermined number within the predetermined amount of time;

in response to the amount collected not reaching the predetermined number within the predetermined amount of time, rolling over the amount collected to another lotto game, creating no prizes, and choosing no winner for the lotto game;

in response to the amount collected reaching the predetermined number within the predetermined amount of time, creating one or more prizes of set amounts in whole number increments of the predetermined number from the amount collected, wherein a remainder of the amount collected, after reducing the amount collected by a sum of the one or more prizes created, is rolled over to the another lotto game;

in response to creating the one or more prizes:

randomly selecting a number of series of second numbers after the predetermined amount of time, wherein the number is equal to a number of the one or more prizes;

comparing the series of first numbers to each of the number of series of second numbers; and selecting one or more of the players as winners of the lotto game in response to the comparing of the series of first numbers to each of the number of series of second numbers, the winners receiving a prize of the one or more prizes; and utilizing one or more training algorithms made up of one or more neural networks for predicting dates of which the predetermined number will be reached, the one or more neural networks having been trained with previous lotto game data.

2. The lotto game system of claim 1: wherein the predetermined amount of time is a month.

3. The lotto game system of claim 1: wherein the predetermined number is one million dollars.

4. The lotto game system of claim 1: wherein the instructions are executed by the computing system to further perform:

initiating an advertising system on the one or more computing devices when the predetermined number has not been reached, wherein a contribution by an advertiser is correlated with how long and a location of an advertisement of the advertising system.

5. The lotto game system of claim 4: wherein receiving the one or more payments for the lotto game from the one or more computing devices further comprises scanning one or more receipts from an establishment where the one or more computing devices are located as payment for the lotto ticket and storing receipt information in the one or more databases and associating the receipt information with a player of the players.

6. The lotto game system of claim 1;

wherein the instructions are executed by the computing system to further perform:

determining a previous series of first numbers associated with the first player; and modifying a future series of first numbers in response to the determination.

7. The lotto game system of claim 6:

wherein the instructions are executed by the computing system to further perform:

displaying the previous series of first numbers associated with the first player and previous results; and presenting options for selection of similar or dissimilar numbers for the future series of first numbers in relation to the previous series of first numbers.

8. The lotto game system of claim 1: wherein one of the one or more computing devices is a kiosk.

9. The lotto game system of claim 1: wherein one of the one or more computing devices is a mobile device.

10. The lotto game system of claim 1:

wherein overlapping qualities after a predetermined number of occurrences in past prizes over a certain range create a cluster which is then stored as one or more variables wherein the cluster provides a higher weighted average in the determination of a predicted number of prizes.

11. The lotto game system of claim 1: wherein the instructions are executed by the computing system to further perform:

creating one or more secondary prizes for one or more of the players who did not win the one or more prizes.

12. The lotto game system of claim 11: wherein the instructions are executed by the computing system to further perform:

entering the players into one or more games for the one or more secondary prizes by returning the lotto tickets and providing one or more discounts for store locations where the lotto ticket were purchased.

13. The lotto game system of claim 11: wherein the instructions are executed by the computing system to further perform:

allocating unclaimed prizes of the one or more prizes for the one or more secondary prizes.

14. The lotto game system of claim 11: wherein the instructions are executed by the computing system to further perform:

allocating unclaimed prizes of the one or more prizes after a second predetermined amount of time.

15. The lotto game system of claim 11: wherein the instructions are executed by the computing system to further perform:

selecting players of the players for the one or more secondary prizes in response to the players reaching a predetermined amount of losses.

* * * * *